US012369708B2

(12) United States Patent
Guglielmi

(10) Patent No.: US 12,369,708 B2
(45) Date of Patent: Jul. 29, 2025

(54) EXPANDABLE TABLE

(71) Applicant: Stelvio Guglielmi, Ho Chi Minh (VN)

(72) Inventor: Stelvio Guglielmi, Ho Chi Minh (VN)

( * ) Notice: Subject to any disclaimer, the term of this patent is extended or adjusted under 35 U.S.C. 154(b) by 156 days.

(21) Appl. No.: 18/228,316

(22) Filed: Jul. 31, 2023

(65) Prior Publication Data

US 2025/0040695 A1 Feb. 6, 2025

(51) Int. Cl.
*A47B 1/03* (2006.01)
*A47B 1/10* (2006.01)

(52) U.S. Cl.
CPC ..... *A47B 1/03* (2013.01); *A47B 1/10* (2013.01); *A47B 2001/035* (2013.01)

(58) Field of Classification Search
CPC .... A47B 1/03; A47B 1/04; A47B 1/05; A47B 2001/053; A47B 2001/035
See application file for complete search history.

(56) References Cited

U.S. PATENT DOCUMENTS 838,671 A * 12/1906 Turner ..... A47B 1/056 108/66
1,547,685 A * 7/1925 Rhodes ..... A47B 13/088 108/66
2,699,976 A * 1/1955 Ranney ..... A47B 1/03 108/67
5,156,095 A * 10/1992 Hansbaek ..... A47B 1/03 108/66
5,237,937 A * 8/1993 Peltier ..... A47B 13/088 108/66
6,009,814 A * 1/2000 Rossi ..... A47B 1/05 108/66
7,464,653 B2 12/2008 Dodge
10,383,433 B1 * 8/2019 Guglielmi ..... A47B 1/03
2004/0194672 A1 * 10/2004 Conley ..... A47B 1/02 108/83

(Continued)

FOREIGN PATENT DOCUMENTS

CN 102038362 A 5/2011
CN 207220469 U 4/2018
DE 20311144 U1 10/2003

*Primary Examiner* — Daniel J Rohrhoff
(74) *Attorney, Agent, or Firm* — COATS & BENNETT, PLLC

(57) ABSTRACT

The expandable table comprises a base or pedestal that rests on the floor or other support surface, a frame supported by the pedestal, and a tabletop. The tabletop comprises a plurality of main table sections that join at a common center to form a small table and a plurality of expansion leaves that can be inserted between the main table sections as needed to create a table with larger surface area. Pivot member connect the outer section of the expansion leaf to the frame so as to rotate about a pivot axis between the deployed position and the storage position and a lift guide attached to an expansion rail of the frame. Lift guides attached to the frame guide the inner section of the expansion leaf along an inclined path between the storage position and the deployed position when the outer section is rotated about a pivot axis. In some embodiments, a removable stopper prevents the main table sections from sliding off the end of the main rails. The stopper can be removed to allow installation and/or replacement of a wedge-shaped segment.

20 Claims, 20 Drawing Sheets

(56) References Cited

U.S. PATENT DOCUMENTS

| | | | | |
|---|---|---|---|---|
| 2006/0075940 | A1* | 4/2006 | Dodge | A47B 13/10 108/86 |
| 2016/0338485 | A1* | 11/2016 | Lin | A47B 1/05 |
| 2017/0127820 | A1* | 5/2017 | Bortolato | A47B 13/088 |
| 2017/0360187 | A1* | 12/2017 | Rossi | A47B 1/03 |

* cited by examiner

EXPANDABLE TABLE

TECHNICAL FIELD

The present disclosure relates generally to expandable tables and, more particularly, to improvements in jupe-type expandable tables.

BACKGROUND

A jupe-type table, also known as an expanding round table, is a versatile piece of furniture that combines the elegance of a round table with the functionality of an expandable table surface. The tabletop comprises a plurality of main table sections that join at a common center to form a small table and a plurality of expansion leaves that can be inserted between the main table sections as needed to create a table with larger surface area. When the table is fully closed, the leaves are neatly stored below the table surface, creating a small table surface. The main table sections diverge when they are pulled radially outward to provide space for the insertion of the expansion leaves, creating a larger table surface. Jupe-type tables can serve as a compact dining table for everyday use, but when expanded, provide ample space for hosting larger gatherings or events. Examples of jupe-type tables are described in U.S. Pat. No. 7,464,653 to Dodge and U.S. Pat. No. 10,383,433 to Guglielmi.

SUMMARY

The present disclosure relates to improvements in expandable, jupe-type tables. The expandable table comprises a base or pedestal that rests on the floor or other support surface, a frame supported by the pedestal, and a tabletop. The tabletop comprises a plurality of main table sections that join at a common center to form a small table and a plurality of expansion leaves that can be inserted between the main table sections as needed to create a table with larger surface area. When the table is fully closed, the expansion leaves are neatly stored below the table surface. The main table sections diverge when they are pulled radially outward to provide space for the insertion of the expansion leaves 60, creating a larger table surface.

The expandable table includes a frame comprising a plurality of main rails extending radially between the center of the frame and a plurality of expansion rails branching off of the main rails. The main table sections of the tabletop slidably mount to respective main rails so as to move radially inward and outward along the main rails. The expansion leaves slidably mount to respective expansion rail sets to move between a storage (folded) position and a deployed (unfolded) position.

One aspect of the disclosure comprises a deployment mechanism to facilitate deployment of the expansion leaves from the storage position in the compact configuration to a deployed position in the expanded configuration. The deployment mechanism comprises, for each expansion leaf, a pivot member connecting the outer section of the expansion leaf to the frame so as to rotate about a pivot axis between the deployed position and the storage position and a lift guide attached to an expansion rail of the frame. The lift guide has a guide surface engaged by a follower on the expansion leaf to guide the inner section of the expansion leaf along an inclined path between the storage position and the deployed position when the outer section is rotated about a pivot axis.

In some embodiments, the guide surface of the lift guide includes a peak intermediate the ends of the guide surface, a launch portion extending upward from a starting level to the peak of the guide surface, and a landing portion defining an ending level lower than the peak of the guide surface. During deployment of the expansion leaf, the follower begins at the starting level in the launch portion of the guide surface, travels upward along the launch portion of the guide surface, over the peak of the guide surface, and comes to rest in the landing portion of the guide surface.

Another aspect of the disclosure comprises a removable stopper to prevent the main table sections from sliding off the ends of the main rails during use. The stoppers can be removed to allow installation and/or re[placement of the main table sections.

DETAILED DESCRIPTION

Figure 1:
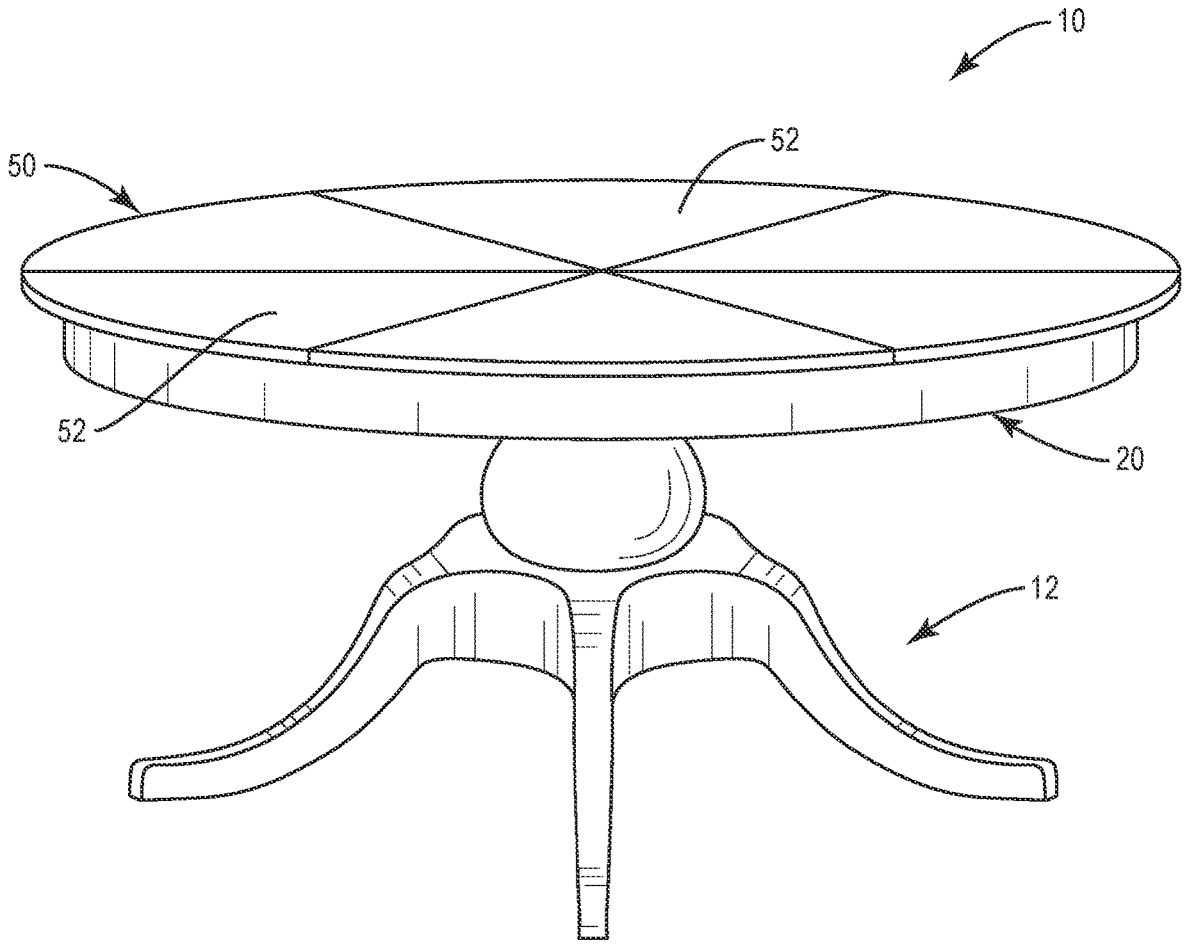
FIG. 1 is a perspective view of an expandable table in a closed or compact configuration.
Figure 2:
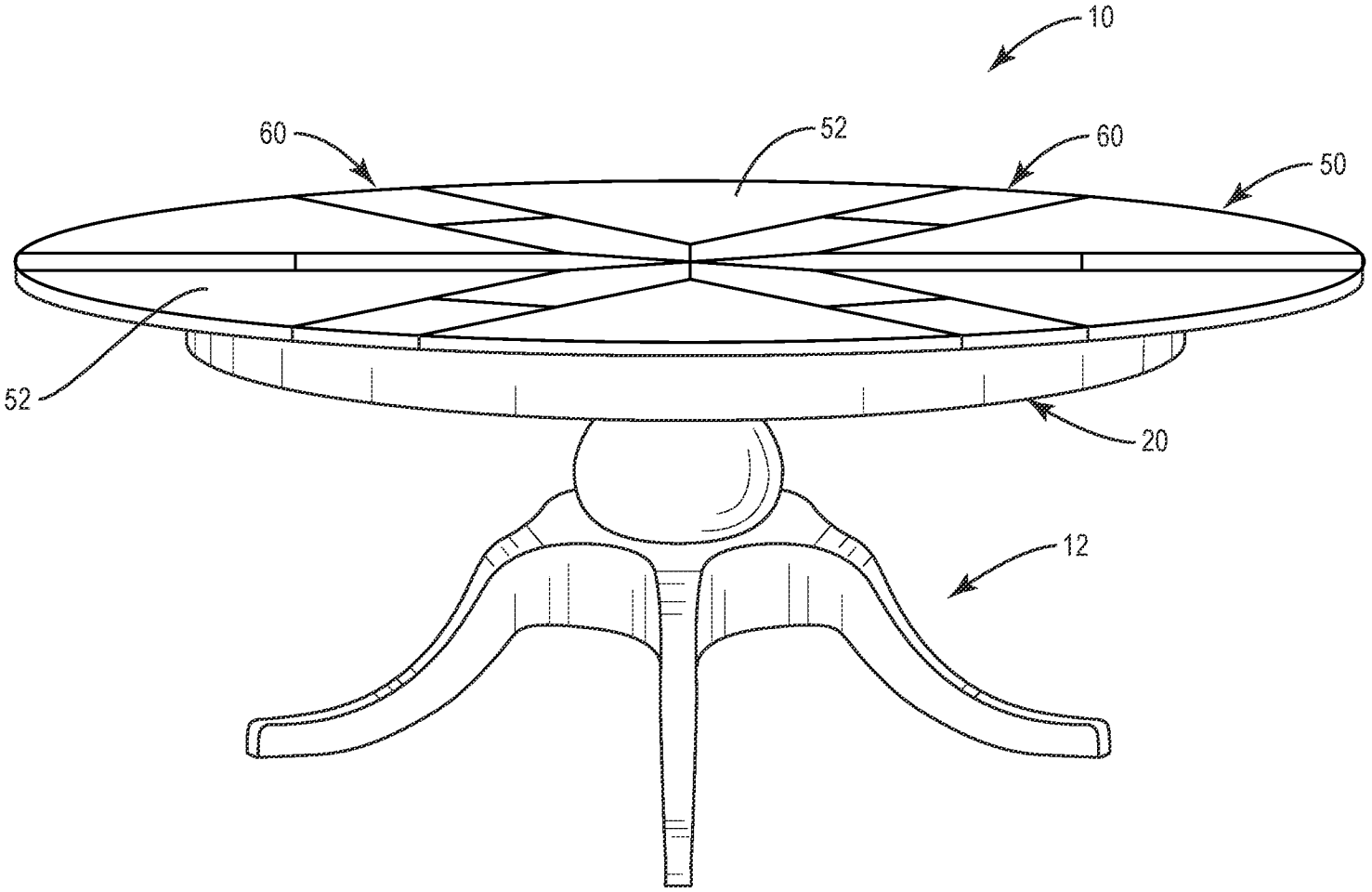
FIG. 2 is a perspective view of an expandable table in an open or expanded configuration.

Referring now to the drawings, FIGS. 1 and 2 illustrate an expandable table 10 according to an exemplary embodiment. Expandable table 10 comprises a base or pedestal 12 that rests on the floor or other support surface, a frame 20 supported by the pedestal 12, and a tabletop 50. Tabletop 50 comprises a plurality of main table sections 52 that join at a common center to form a small table as shown in FIG. 1 and a plurality of expansion leaves 60 that can be inserted between the main table sections 52 as needed to create a table with larger surface area as shown in FIG. 2. In the illustrated embodiment, the main table sections 52 are wedge-shaped or pie-shaped so that the table surface approximates a circle. When table 10 is fully closed, the expansion leaves 60 are neatly stored below the table surface. The main table sections 52 diverge when they are pulled radially outward to provide space for the insertion of the expansion leaves 60, creating a larger table surface.

Figure 3A:
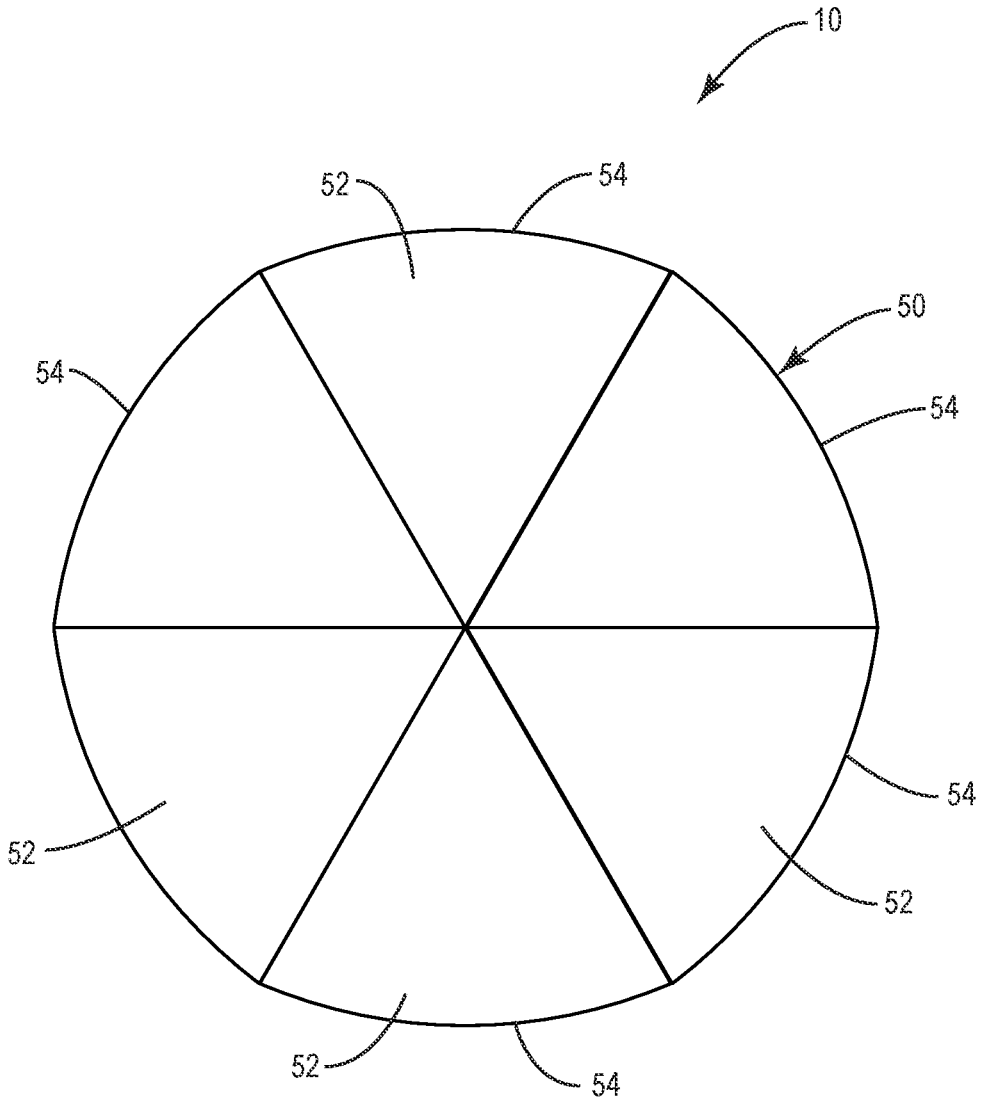
FIGS. 3A-3D illustrate steps for expanding the expandable table.
Figure 3B:
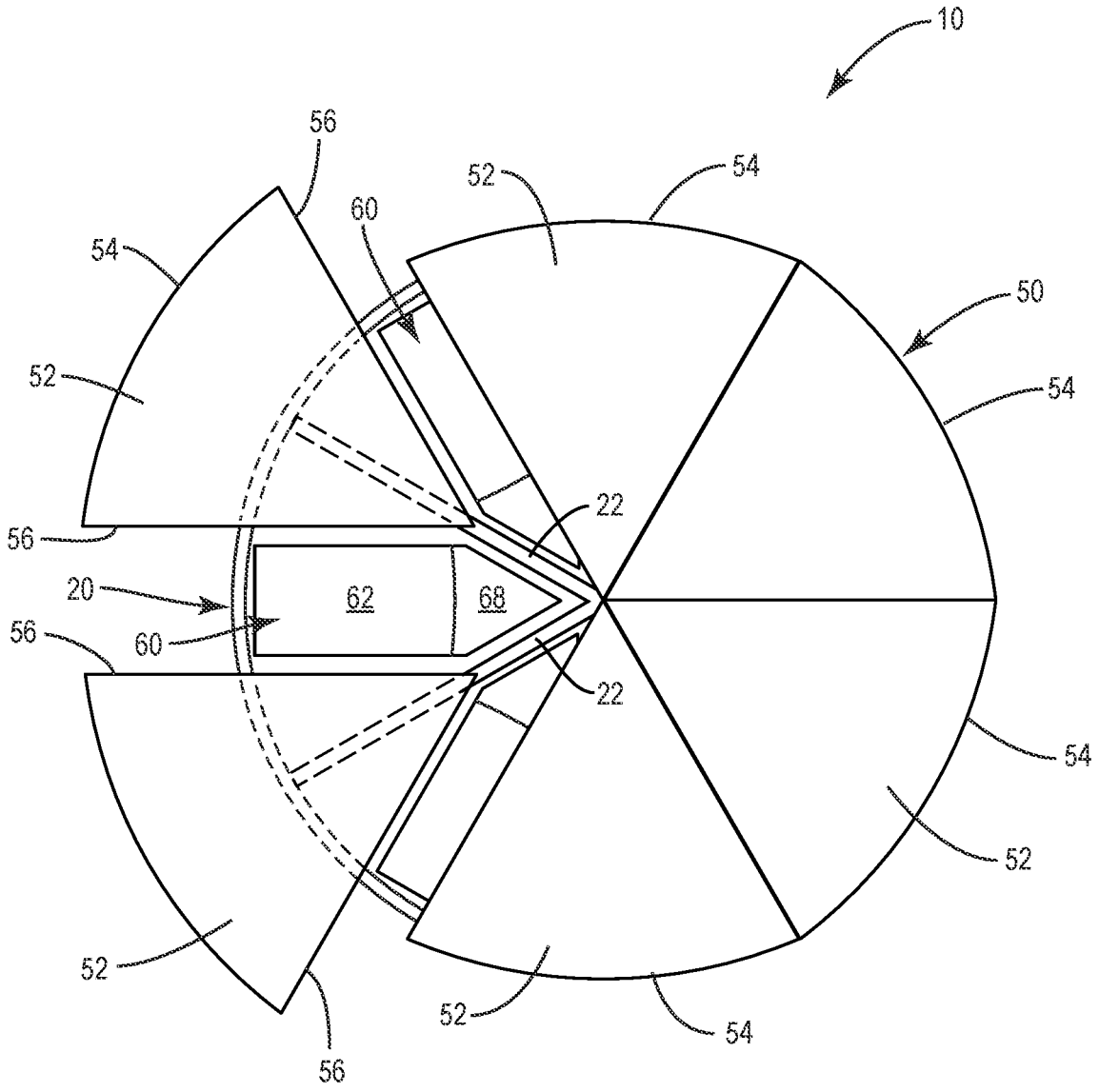
Figure 3C:
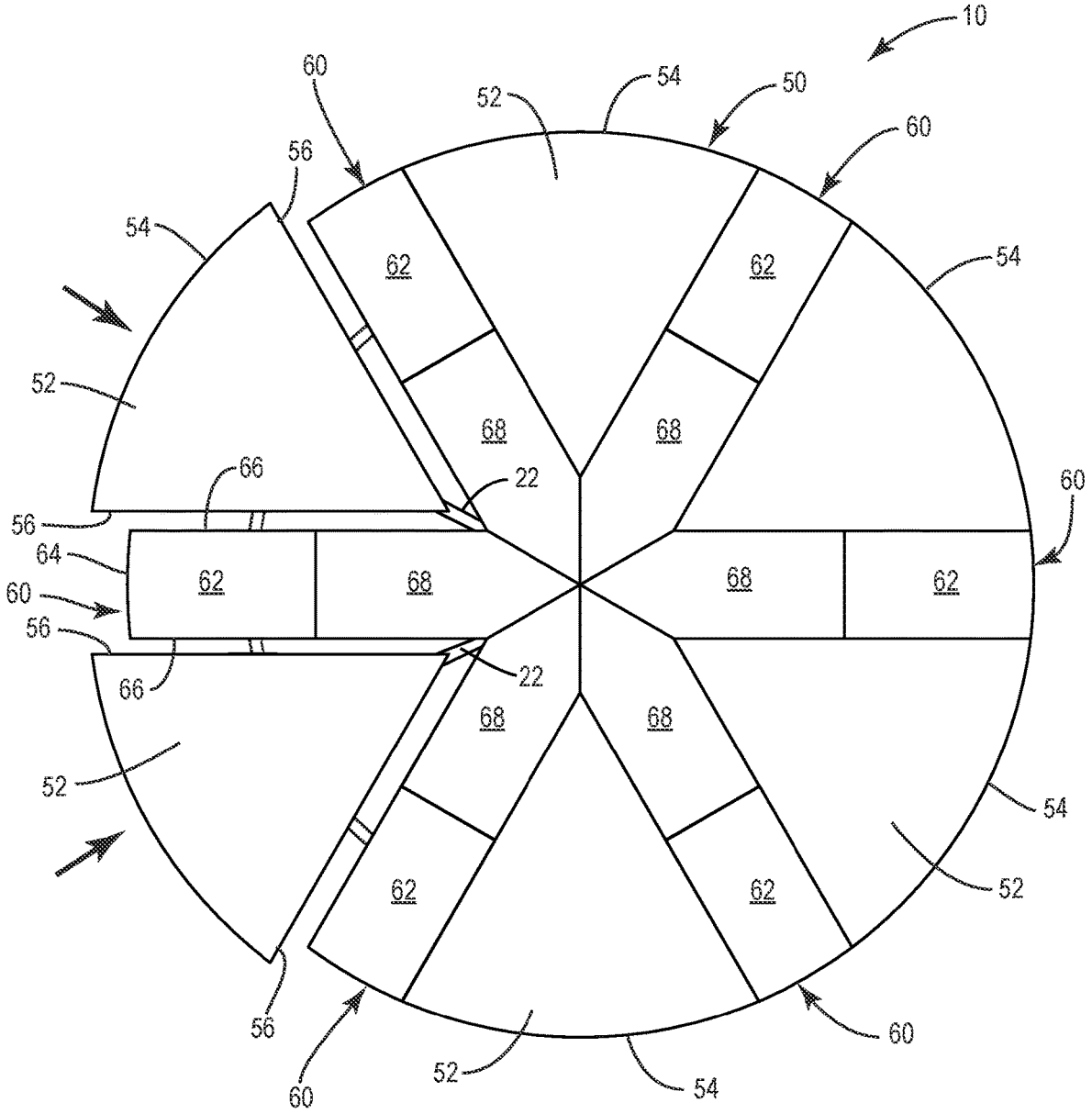
Figure 3D:
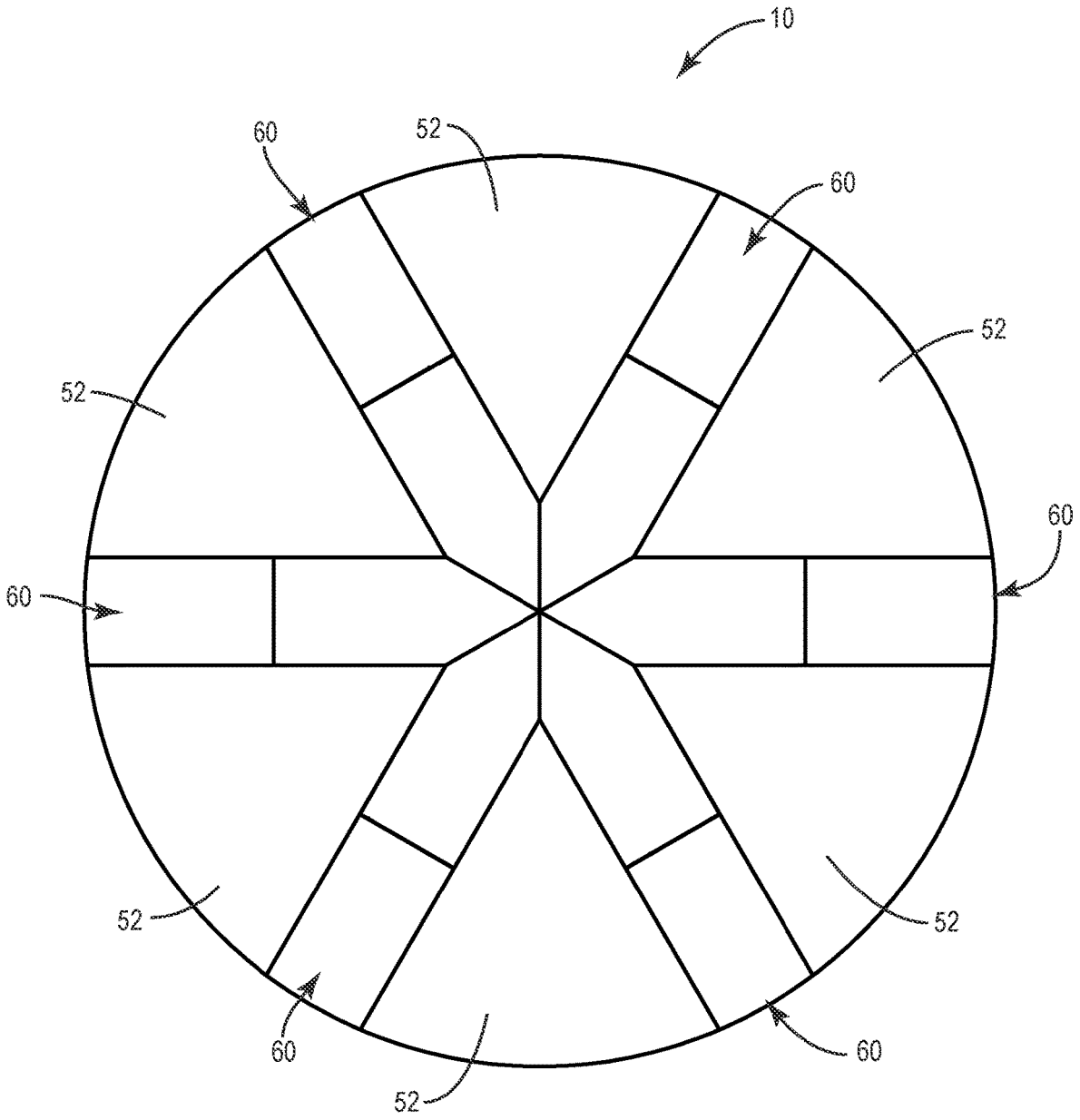

FIGS. 3A-3D illustrate how table 10 expands to form a large table surface. FIG. 3A shows table 10 in the closed or compact configuration providing a small table surface. To expand table 10, the user pulls the main table sections 52 radially outward. When pulled radially outward, the wedge shaped sections 52 diverge from one another to expose the expansion leaves 60 underneath the table surface as shown in FIG. 3B. The expansion leaf 60 visible in FIG. 3B is in a folded configuration. To deploy the expansion leaves 60, the user unfolds and positions the expansion leaves 60. The process of unfolding and deploying the expansion leaves 60 raises the expansion leaves 60 into the plane of the table surface. FIG. 3C shows the expansion leaves 60 in the unfolded or deployed position. Following deployment of the expansion leaves 60, the user pushes the main table sections 52 and expansion leaves 60 radially inward, which causes the main table section 52 and expansion leaves 60 to converge and form the large table surface as shown in FIG. 3D.

Figure 4:
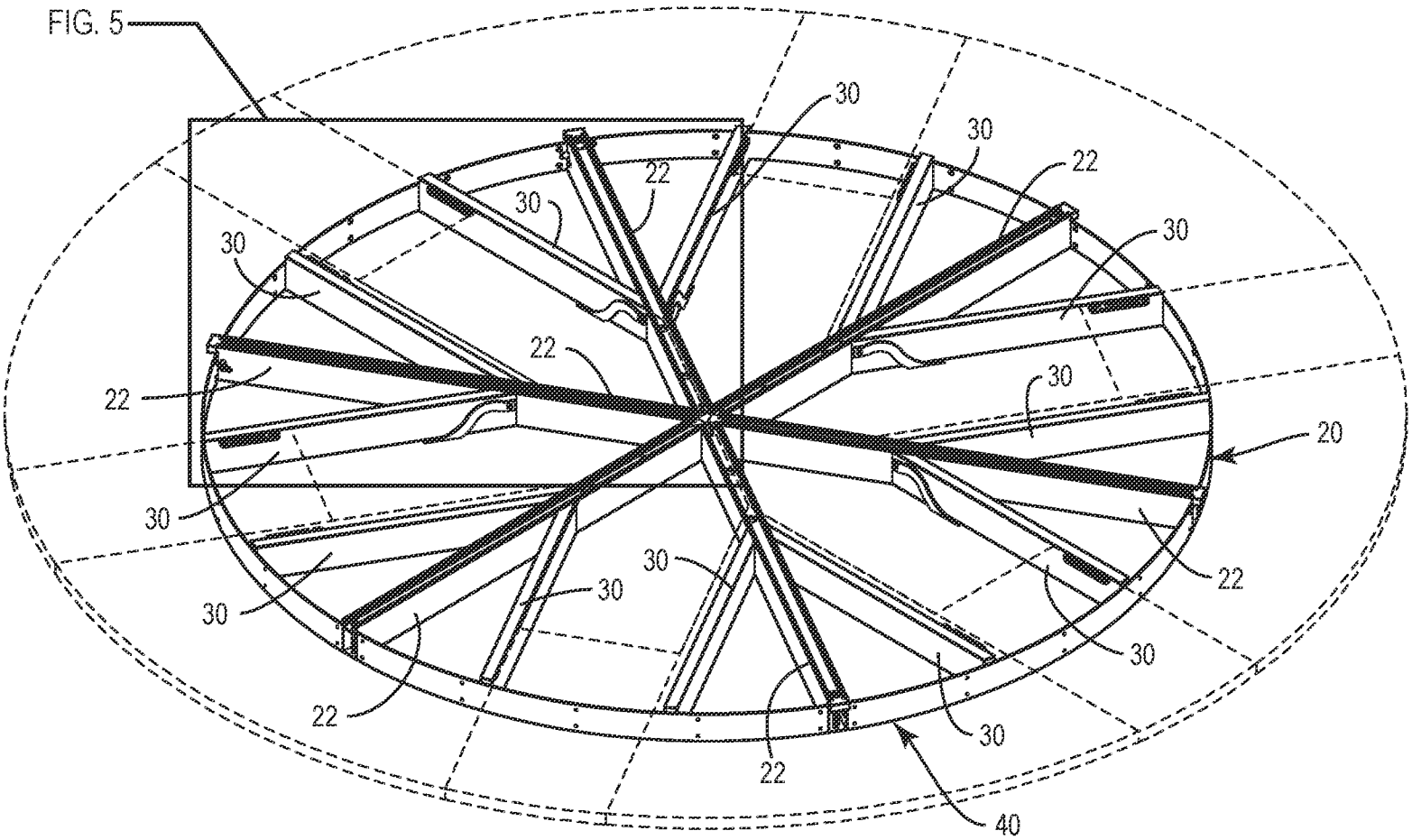
FIG. 4 is a perspective view of a frame for the expandable table.

FIG. 4 illustrates frame 20 of the expandable table 10 according to one embodiment. Frame 20 comprises a plurality of main rails 22, a plurality of expansion rails 22 branching off of the main rails 22, and an apron 40. The number of main rails 22 corresponds with the number of main table sections 52. In the illustrative embodiment, there are six main table sections and six main rails 22, although the number of main table sections 52 is not material. The main rails 22 extend outward from the center of frame 20 to the apron 40, which extends circumferentially around frame 20 forming an outer perimeter of frame 20. In each sector of frame 20, two expansion rails 30 extend parallel to one another from respective main rails 22 to the apron 40 to form an expansion rail set. The expansion rails 30 in the same expansion rail set extend parallel to and equidistant from a radial dividing the sector, i.e., the wedge-shaped area defined by two main rails and the apron.

The main table sections 52 slidably mount to respective main rails 22 so as to move radially inward and outward along the main rails 22. The expansion leaves 60 slidably mount to respective expansion rail sets to move between a storage (folded) position and a deployed (unfolded) position.

Figure 5:
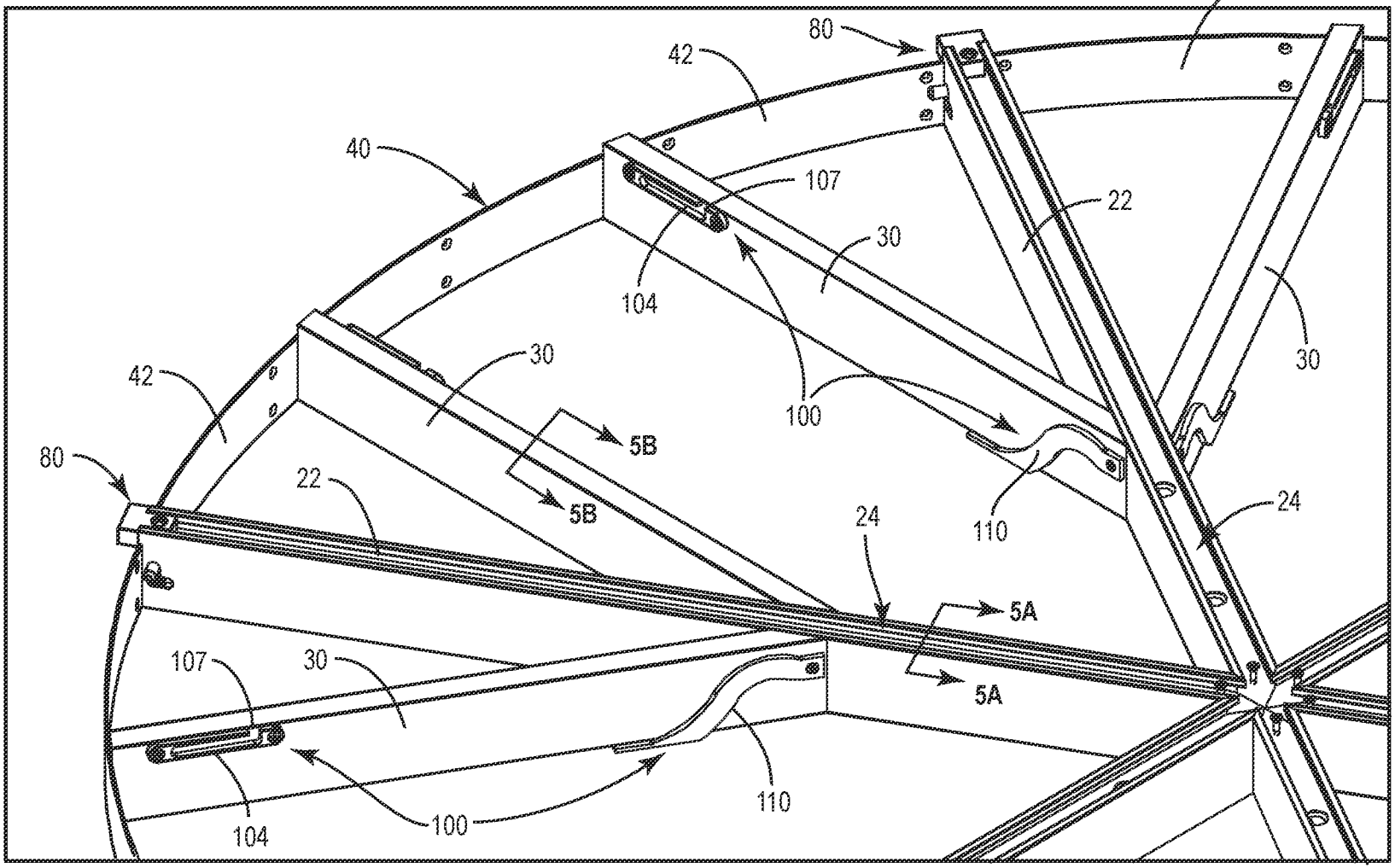
FIG. 5 is a partial perspective view of a frame for the expandable table.
Figure 5A:
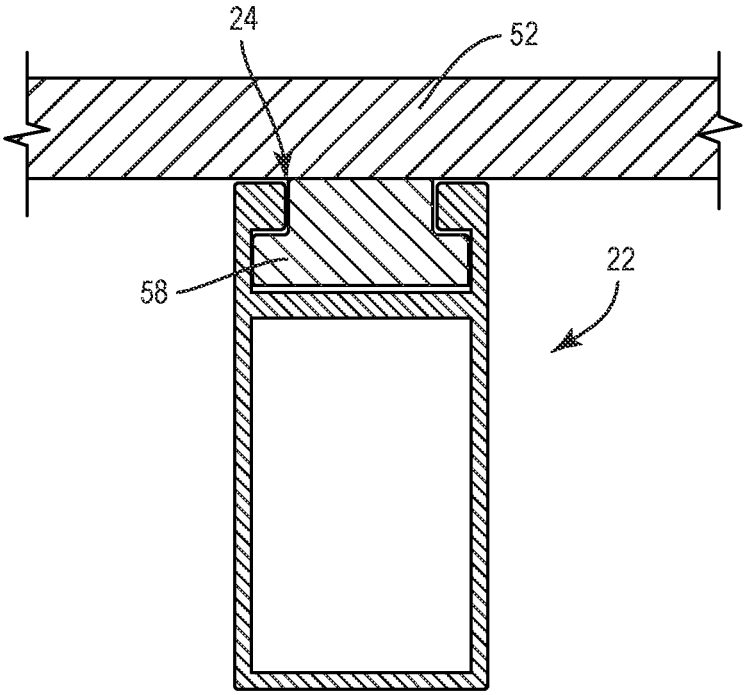
FIG. 5A is a cross-section of a main rail in the frame for the expandable table showing a main table section installed.

The main rails 22 are extruded from aluminum or other lightweight material and include channels 24 (FIG. 5A) in the upper surfaces that serve as tracks for the main table sections 52. Slides 58 attached to the underside of the main table sections 52 travel back and forth in channel 24. Channels 24 and slides 58 are shaped so that the main table section 52 cannot be vertically removed from channel 24. Channel 24 is open at the outer end to allow insertion and removal of the slides 58 attached to the main table sections 52 through the open end.

Figure 8:
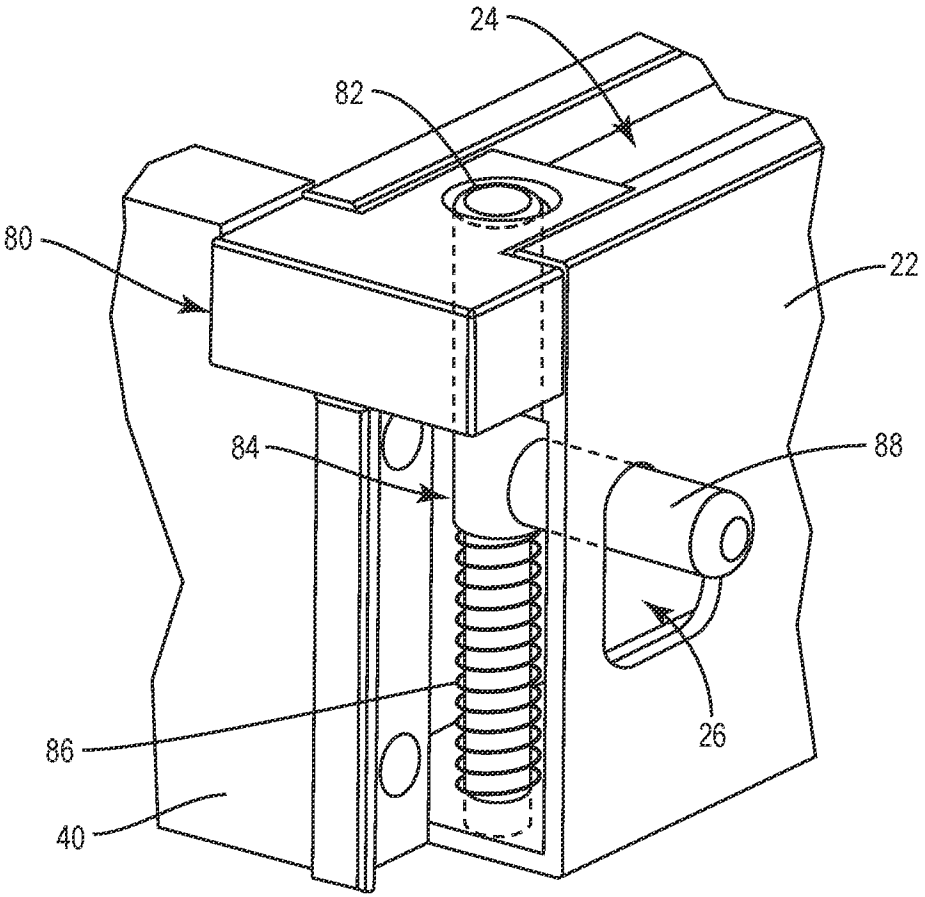
FIG. 8 is a partial perspective view showing a removable stopper for the main rail of the frame.

In one embodiment, a removable stopper 80 is inserted into the open end of each channel 24 to prevent the main table sections 52 from sliding off of the main rail 22. FIG. 8 illustrates one exemplary embodiment of the removable stopper 80. The stopper 80 comprises a block made of metal, wood, plastic, or composite material. The stopper 80 is shaped for insertion into the end of channel 24 in the main rail 22. The stopper 80 includes a through-hole 82 that is engaged by a stopper pin 84 disposed inside the main rail 22. Spring 86 biases the stopper pin 84 into engagement with the through hole 82 in the stopper 80. The stopper pin 84 includes an arm 88 that extends outward through an opening 26 in the side wall of the main rail 22. A user can remove a main table section 52 of the table 10 by pulling downward on the arm 88 of the stopper pin 84 to disengage the stopper pin 84 from the stopper 80 and removing the stopper 80. Once stopper 80 is removed, slide 58 attached to the underside of the main table section 52 can slide out of the open end of channel 24.

Figure 5B:
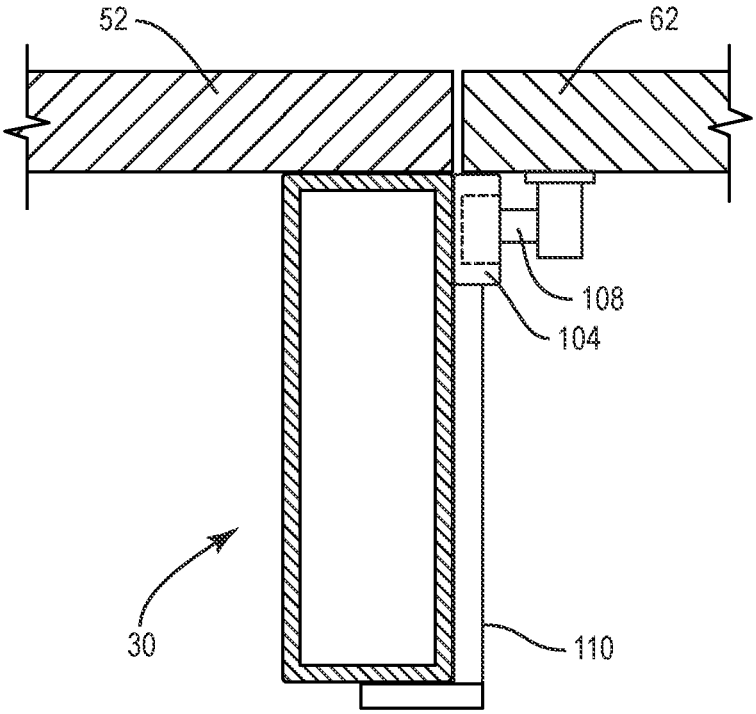
FIG. 5B is a cross-section of an expansion rail in the frame for the expandable table showing the deployment mechanism for an expansion leaf.
Figure 6:
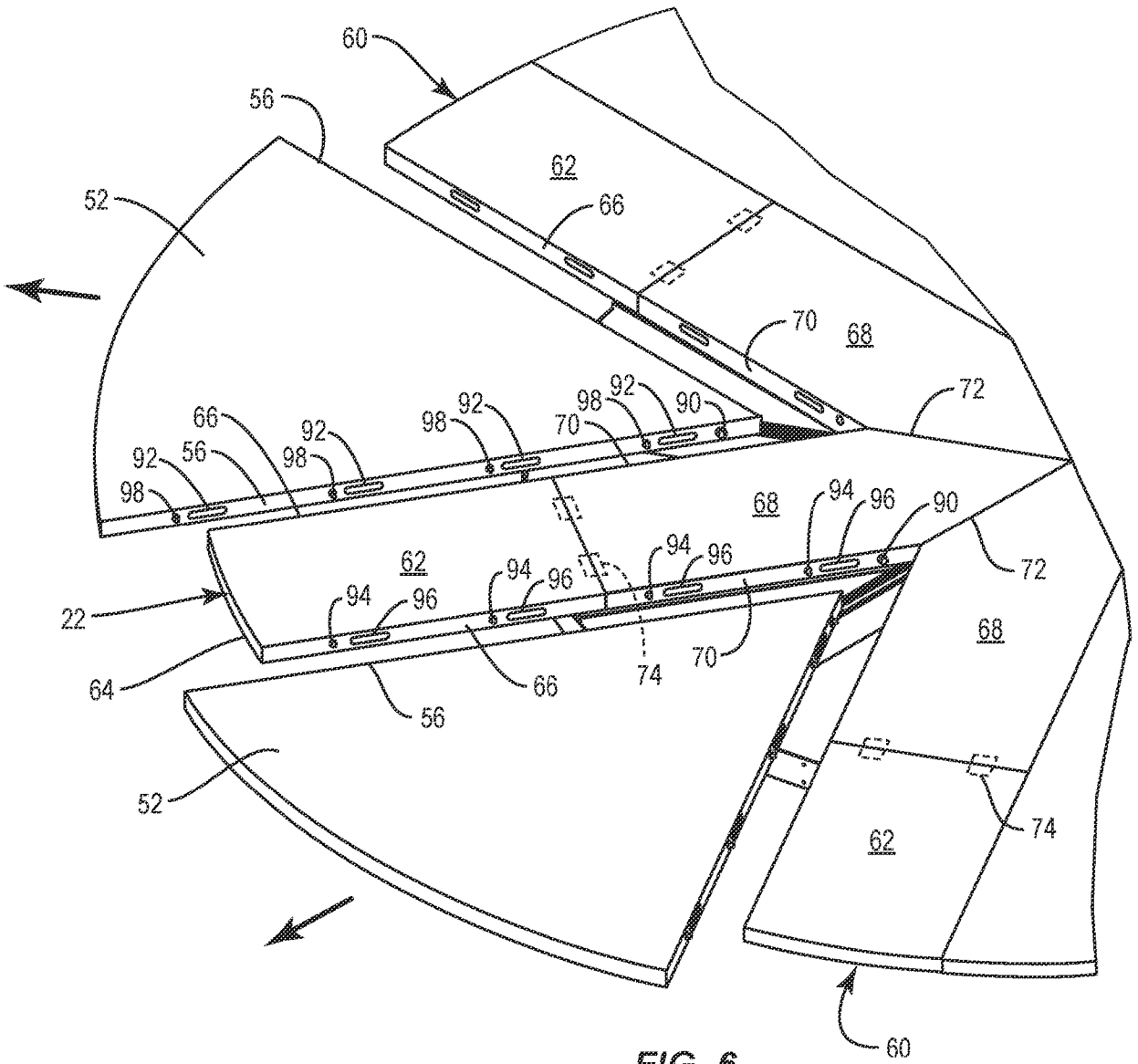
FIG. 6 is a partial perspective view showing the table surface with two main table sections pulled radially outward.

The expansion rails 30 comprise a rectangular tube (FIG. 5B) extruded from aluminum or other lightweight material. Each expansion rail 30 branches off a respective main rail 22 and extends to the apron 40 as seen in FIG. 4. The expansion rails 30 are preferably welded to the main rails 22 but other forms of attachment, such as threaded fasteners, can also be used. The two expansion rails 30 between the same pair of main rails 22 extend parallel to one another and form an expansion rail set for an expansion leaf 60. A deployment mechanism 100 described in more detail below comprising a sliding pivot 102, lift guide 110, and follower 120 supports each expansion leaf 60 between a respective expansion rail set.

The apron 40 comprises six curved segments 42. Each curved segment 42 is attached at opposing ends to respective main rails 22. The curved segments 42 may be secured to the main rails 22 and expansion rails 30 by weldment or threaded fasteners. In either case, the curved segments 42 join with the main rails 22 so that the open ends of the channels 24 in the main rails 22 are not obstructed. The outer surface of curved segments 42 may be covered by a wood laminate or other material giving the appearance of a natural wood finish.

As previously noted, the tabletop 50 comprises a plurality of main table sections 52 and a plurality of expansion leaves 60. The main table sections 52 and expansion leaves 54 can be made or wood, or composite material with a natural wood appearance. In one embodiment, the components of the tabletop 50 are made of blockboard. The components of the tabletop 50 can be shaped to form a perfect circle in either the closed configuration, or the expanded configuration.

Each main table section 52 has an outer curved edge 54 and converging sides 56 forming an approximate sector of a circle. A slide 58 is attached to the underside of each main table section 52. Slide 58 fits in channel 24 in one of the main rails 22 and allows the main table section 52 to slide radially inward and outward along the main rail 22.

Each expansion leaf 60 comprises two parts: an outer section 62 and an inner section 68. The outer section 62 and inner section 68 of each expansion leaf 60 are connected by a hinge 74 that allows the expansion leaf 60 to fold into a storage position. The outer section 62 includes a curved outer edge 64 that forms part of the outer perimeter of the tabletop 50 in the expanded configuration and parallel sides 66 that abut with the sides of the main table sections 52 in the expanded configuration. The inner section 68 has two parallel sides 70 and two converging sides 72 forming an overall-pencil-shape with a pointed end. The parallel sides 70 abut the converging sides 52 of the main table sections 52 in the expanded configuration, while the converging sides 72 abut the converging sides 72 of another expansion leaf 60 in the expanded configuration.

The expansion leaves 60 are mounted to respective expansion rail sets by a deployment mechanism 100. In the disclosed embodiment, a separate deployment mechanism is provided for each expansion leaf 60. The deployment mechanism 100 for an expansion leaf 60 comprises three main components: a sliding pivot 102, and lift guide 110, and a follower 120. Each expansion leaf 60 uses two sliding pivots 102, two lift guides 110, and two followers 120, i.e., one of each for each side of the expansion leaf 60. The sliding pivots 102 rotatably connect the expansion leaf 60 to the parallel expansion rails 30 in an expansion rail set, so that the expansion leaf 60 can be rotated between the storage position and the deployed position as hereinafter described. The lift guide 110 and follower 120 guide the pointed end of the expansion leaf into position while the expansion leaf 60 is being deployed.

The sliding pivot 102 comprises two main parts: a slotted bracket 104 with a guide slot 106 and a pivot pin 108. The slotted brackets 104 mount to vertical surfaces of expansion rails 30 facing the expansion leaf 60. The pivot pins 108 mount to the underside of the outer section 62 of the expansion leaf 60 and extend outward from the parallel sides 66 of the outer section 52. The axis of the pivot pin 108 is offset vertically from the plane of the expansion leaf 60. This offset causes the expansion leaf 60 to lift upward into the plane of the table surface when being deployed and to drop back below the plane of the table surface when being returned to the storage position. Slotted brackets 104 include openings 107 that enable the insertion and removal of the pivot pins 108 into the guide slots 106 so that the expansion leaves 30 can be removed. Guide slots 106 allow for some radial movement of the expansion leaf 60 during the deployment of the expansion leaf 60 and the return of the expansion leaf 60 to the storage position.

The lift guide 110 comprises a mounting tab 112 and guide arm 114 made from a flat metal plate. The mounting tab 112 abuts the bottom surface of the expansion rail 30 and provides means for attaching the lift guide 110 to the expansion rail 30. In one embodiment, threaded fasteners secure the lift guide 110 to the bottom surface of the expansion rail 30. The threaded faster passes through an opening (not shown) in the mounting tab 112 and screws into a mounting hole (not shown) in the bottom of the expansion rail. Guide arm 114 lies flat against the vertical surface of the expansion rail 30 and includes an upper surface with a complex curvature. The upper surface functions as a guide surface 116 for the follower 120 as hereinafter described. The complex curvature includes three parts. The first part referred to herein as the launch portion comprises a concave curve that curves upwardly. The second part referred to herein as the central portion comprises a convex curve that defines a peak along the guide surface. The third part referred to herein as the landing portion comprises a concave curve that curves downward slightly and then flattens to forms a landing area for the follower 120 in the deployed position.

Figure 7A:
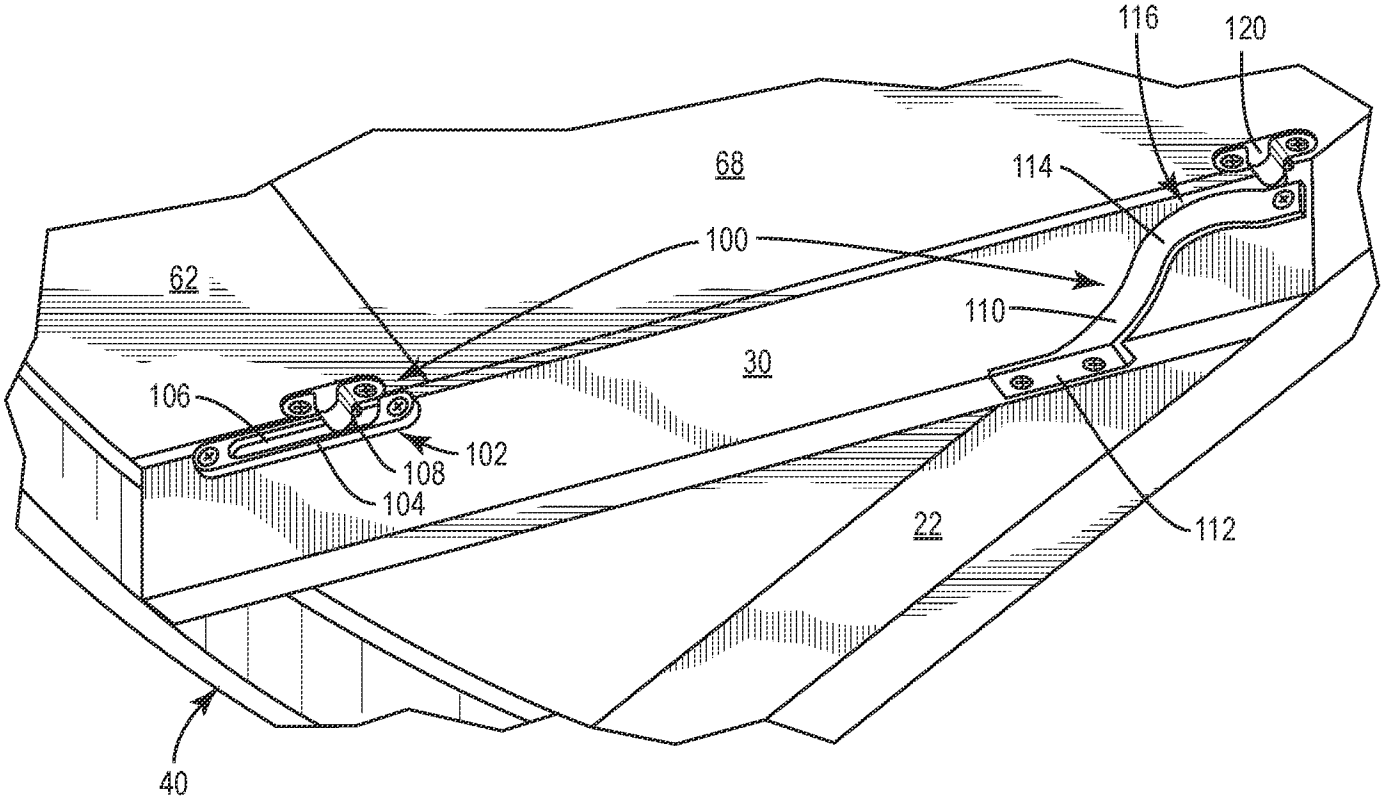
FIGS. 7A and 7B are a perspective view showing the deployment mechanism for the expansion leaf.
Figure 7B:
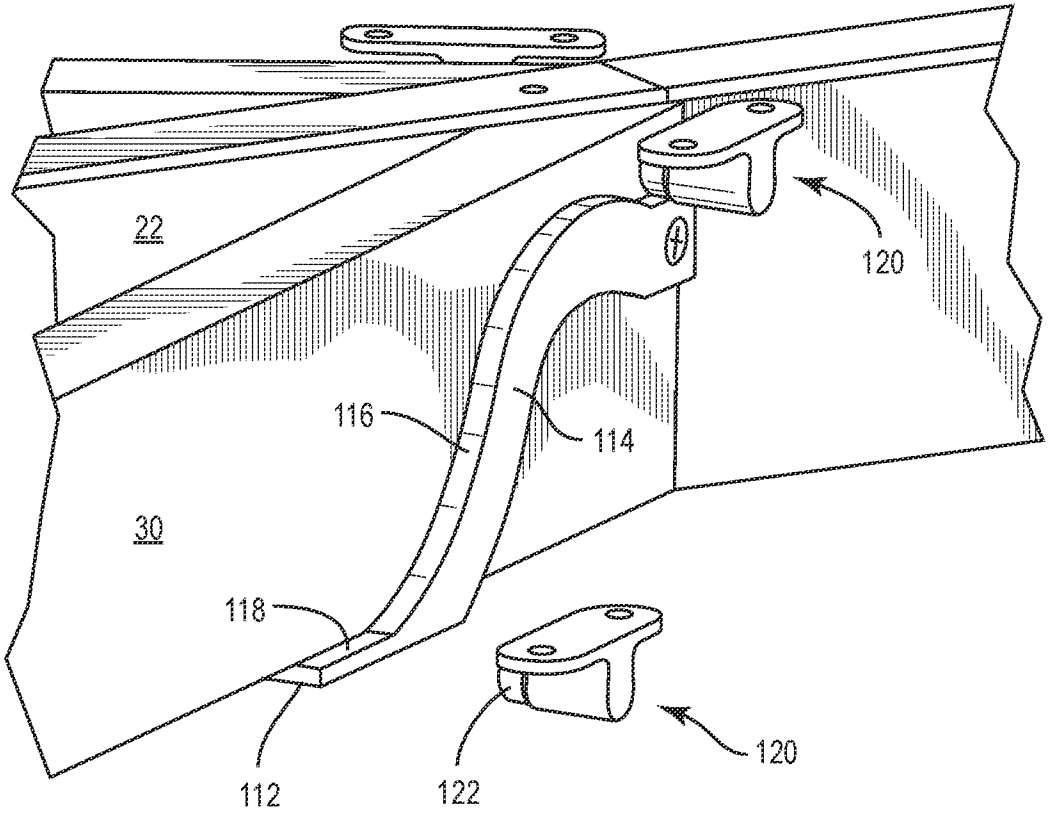

The follower 120 comprises a bearing 122 (FIGS. 7A & 7B) that mounts to the underside of the inner section 68 of the expansion leaf 60. Bearing 122 travels along the guide surface 116 of the guide arm 114 when the expansion leaf 60 is being deployed or returned to storage. In the storage position, the follower 120 rests on an upper surface 118 of the mounting tab 112 that protrudes from the expansion rail 30. The upper surface 118 of the mounting tab 112 functions as a rest stop for the bearing 122 in the storage position. During deployment, the bearing 122 travels up the launch portion of the guide surface 116 and moves toward the landing area. Bearing 122 travels over the peak in the central portion of the guide surface 116 and comes to a stop in the landing area as shown in FIG. 7A. During the return of the expansion leaf 60, the follower 120 moves back from the landing area to the launch portion of the guide surface 116.

Figure 9A:
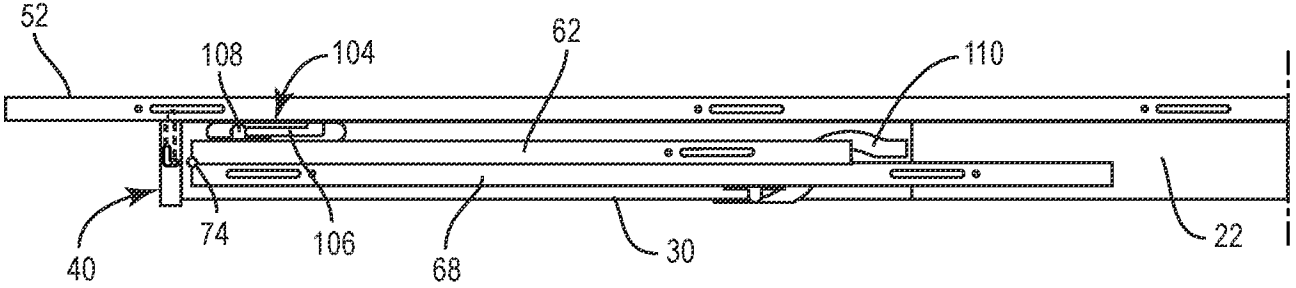
FIGS. 9A-9E are section views illustrating steps for expanding the expandable table.
Figure 9B:
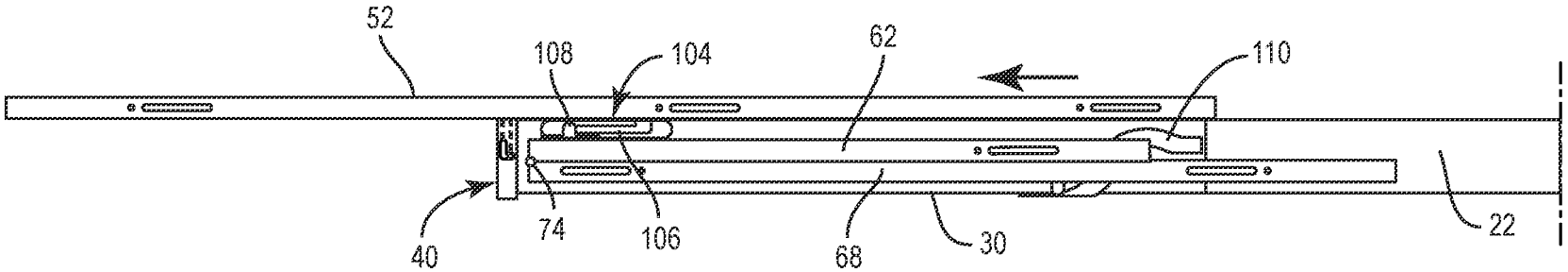
Figure 9C:
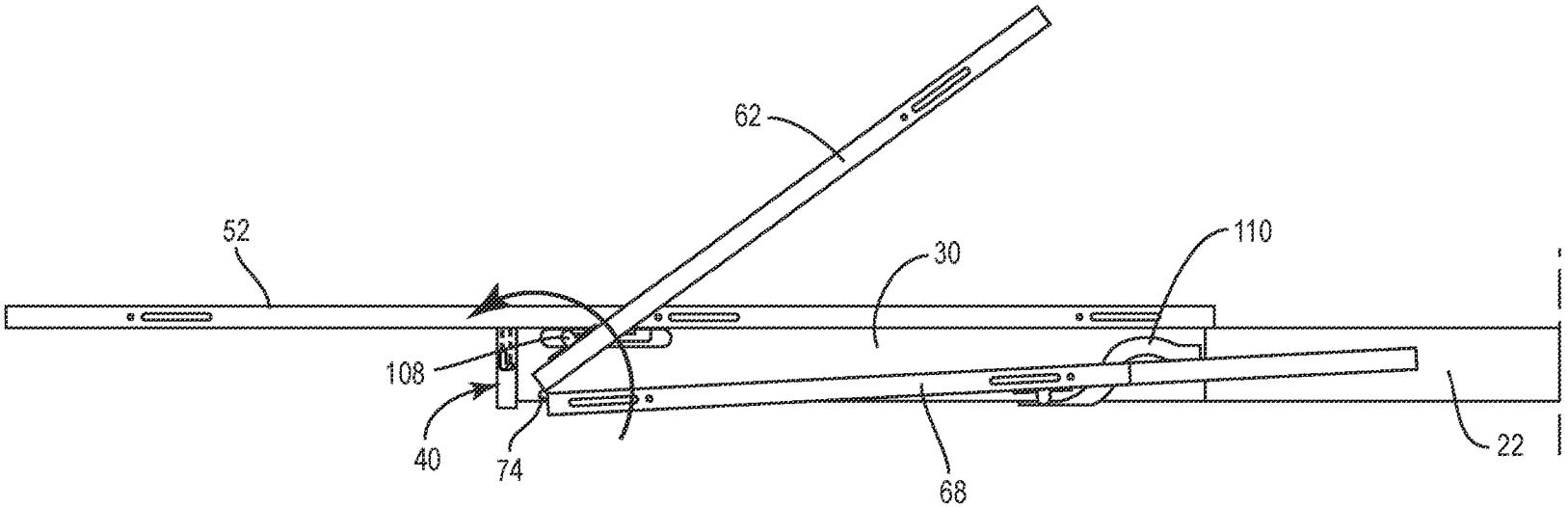
Figure 9D:
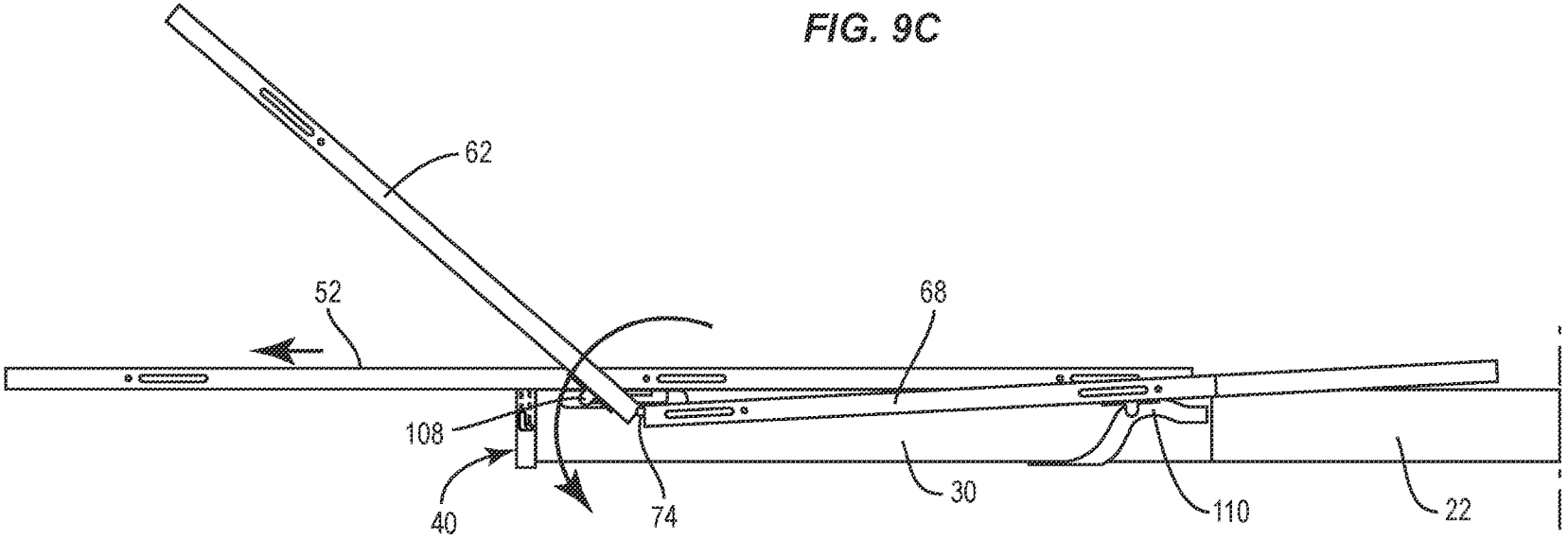
Figure 9E:
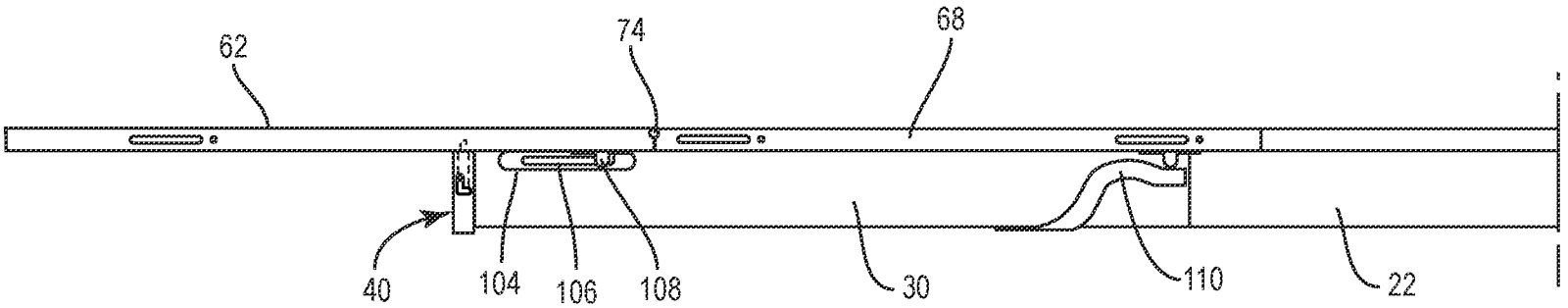
Figure 10:
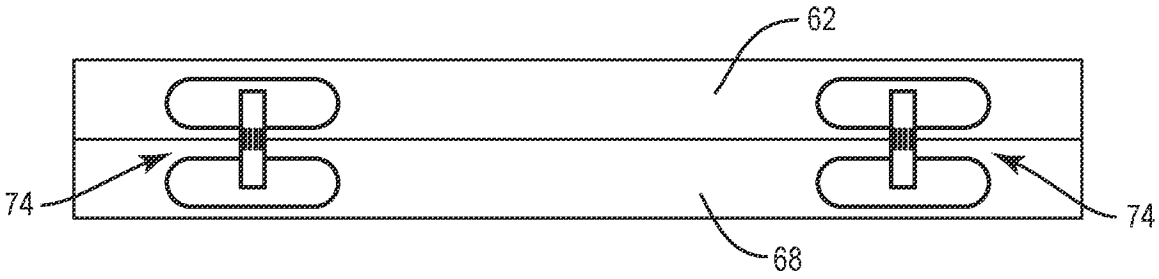
FIG. 10 is an end view of an expansion leaf in a folded configuration showing a hinge.

FIGS. 9A-9D illustrate how the deployment mechanism works. FIG. 9A shows the expansion leaf 60 in a storage position below the table surface. In this configuration, the outer section 62 of the expansion leaf 60 is inverted and folded over on top of the inner section 68. The pivot pin 108 is located toward the outer end of the guide slot 106 in the slotted bracket 104. The bearing 122 of the follower 120 rests on the upper surface 118 of the mounting tab 112. FIG. 9B shows the main table section 52 sliding radially outward to expose the expansion leaf 60. FIGS. 9C and 9D show the expansion leaf 60 being unfolded. When the outer section 62 is being unfolded, the inner section 68 is pushed forward and the bearing 122 of the follower 120 begins to travel upward along the launch portion of the guide surface. Once the expansion leaf 60 is unfolded, the expansion leaf 60 is pushed inward so that the follower 120 passes over the peak in the central portion of the guide surface 116 and comes to a stop in the landing area as shown in FIG. 9E. In the expanded configuration, the pivot pin 108 is located near the inner end of the guide channel 106 in the slotted bracket 104. The shape of the guide arm 114 helps to hold the expansion leaves 30 in place.

In some embodiments, the side edges 56, 66, and 70 of the main table sections 52 and expansion leaves 60 include magnets 90 embedded therein to hold the table sections together. The edges 56 of the main table sections 52 may include a first set of magnets 90 that engage with magnets 90 on adjacent main table sections 52 in the compact configuration, and a second set of magnets 90 that engage with magnets 90 on an adjacent expansion leaf 60 in the expanded configuration. The edges 66, 70 of the expansion leaves 60 include a single set of magnets 90 to engage with the magnets 90 on the main table sections 52.

In some embodiments, the side edges 56, 66, and 70 of the main table sections 52 and expansion leaves 60 include a series of slots 92, 96. The slots 92 in the side edges 56 of the main table sections 52 are engaged by posts 94 extending from the side edges 66, 70 of the expansion leaves 60. The slots 96 in the side edges 66, 70 of the expansion leaves 60 are engaged by posts 98 extending from the side edges 56 of the main table sections 52. The engagement of the posts 94, 98 with the slots 92, 96 prevents the expansion leaves 60 from lifting upward during use.

Figure 11A:
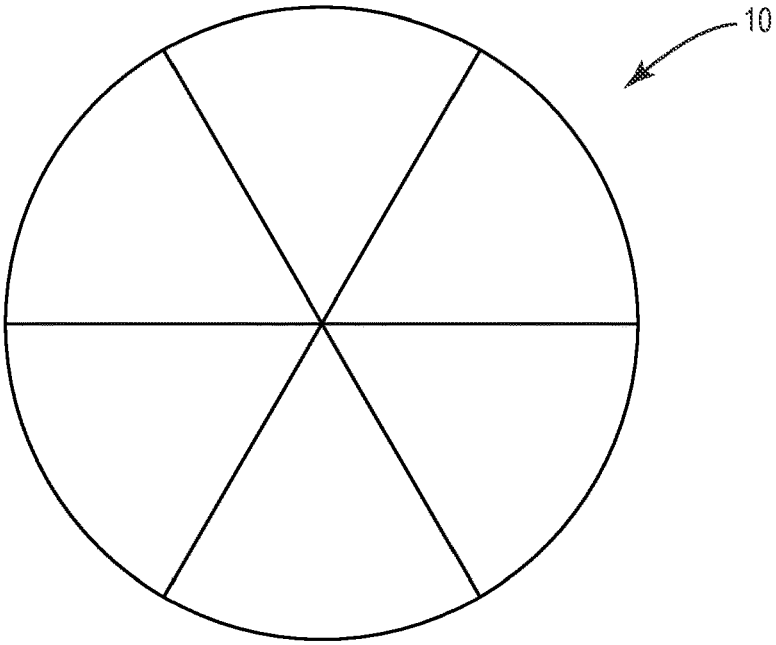
FIGS. 11A and 11B illustrate an alternative embodiment of the expandable table with six main table sections.
Figure 11B:
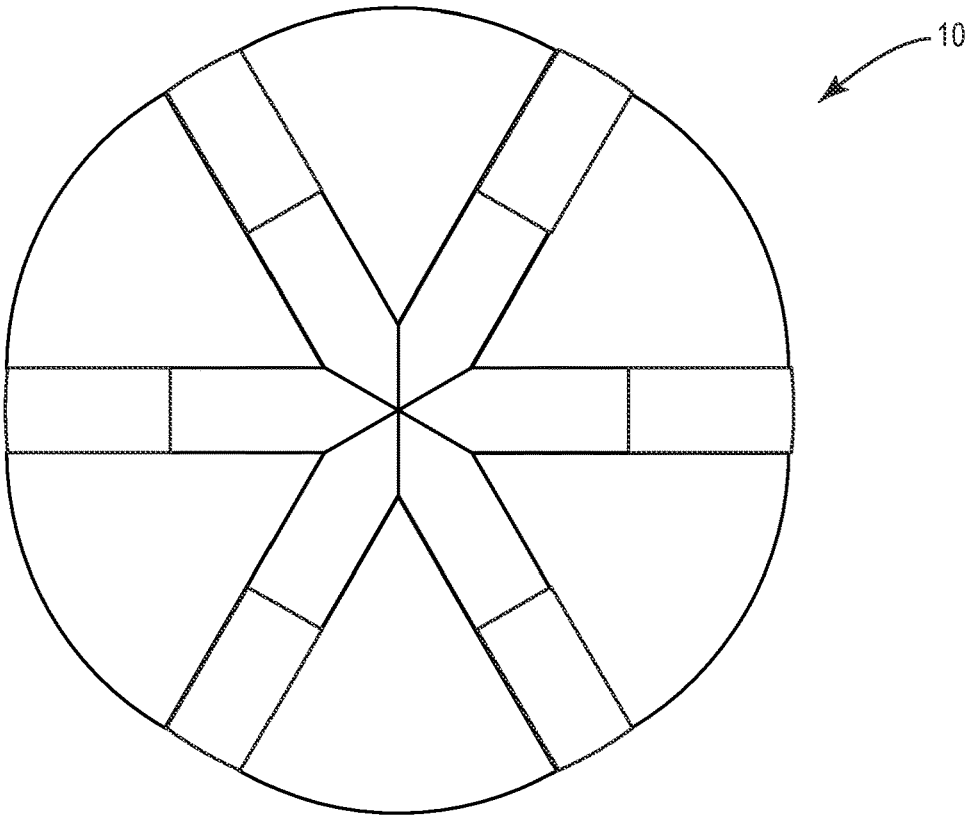

The exemplary table illustrated in the Figures embodies a circular design where table surface comprises a perfect circle in the open or expanded configuration (FIG. 3D) and an irregular circle in the closed or compact configuration (FIG. 3A). Those skilled in the art will appreciate, however, that the table could embody a multitude of shapes and variations. FIGS. 11A and 11B illustrate an alternate embodiment where table surface comprises a perfect circle in the closed or compact configuration (FIG. 11A) and an irregular circle in the open or expanded configuration (FIG. 11B).

Figure 12A:
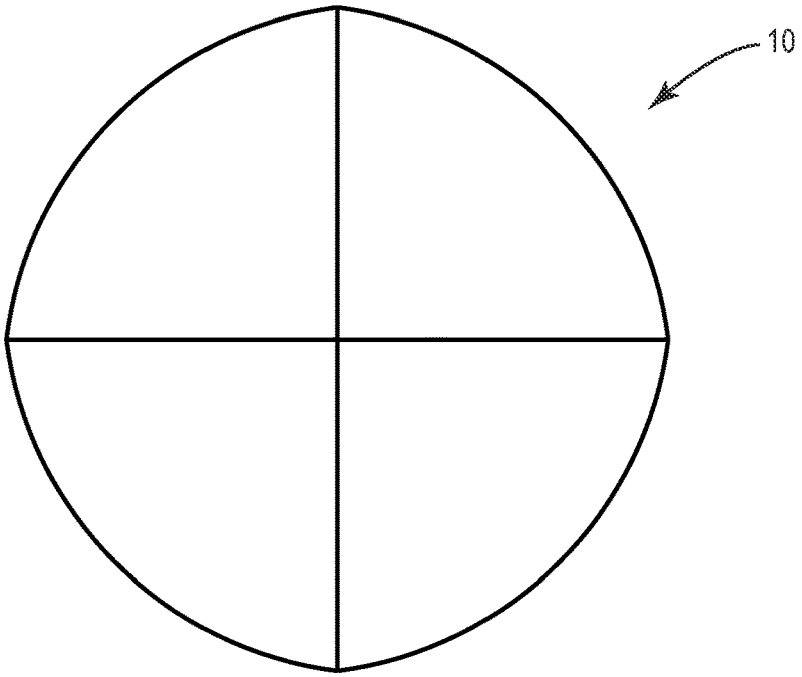
FIGS. 12A and 12B illustrate an alternative embodiment of the expandable table with four main table sections.
Figure 12B:
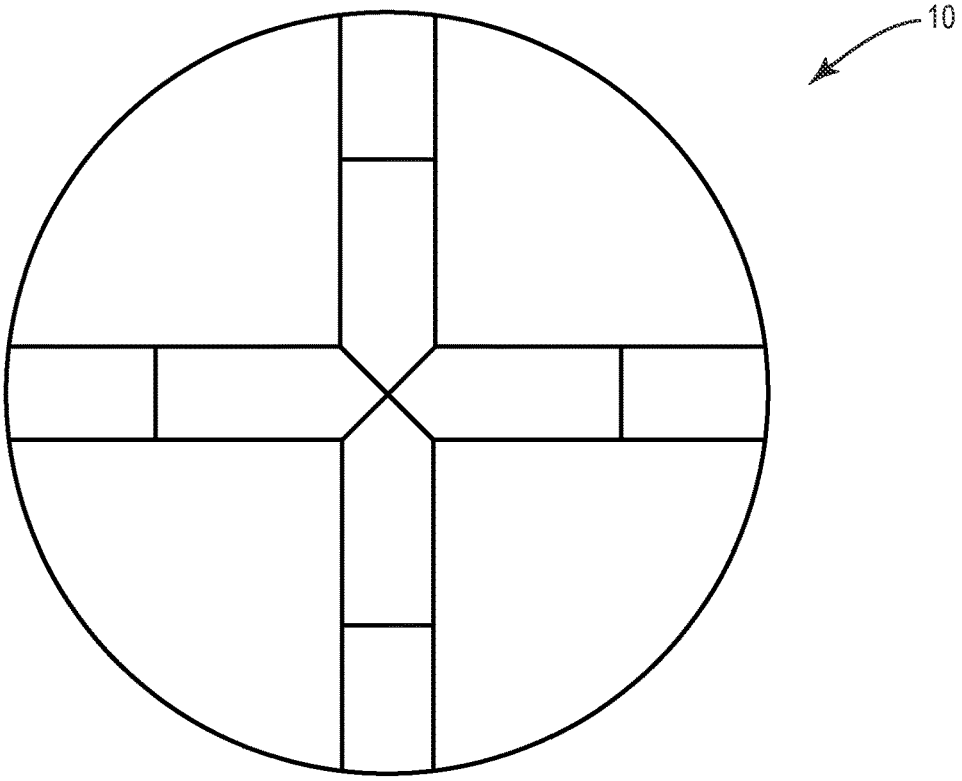

FIGS. 12A and 12B show another circular design where the table includes four main table sections 52 instead of six. Other designs could comprise more than six main table sections 52 or fewer than four main table sections 52.

Figure 13A:
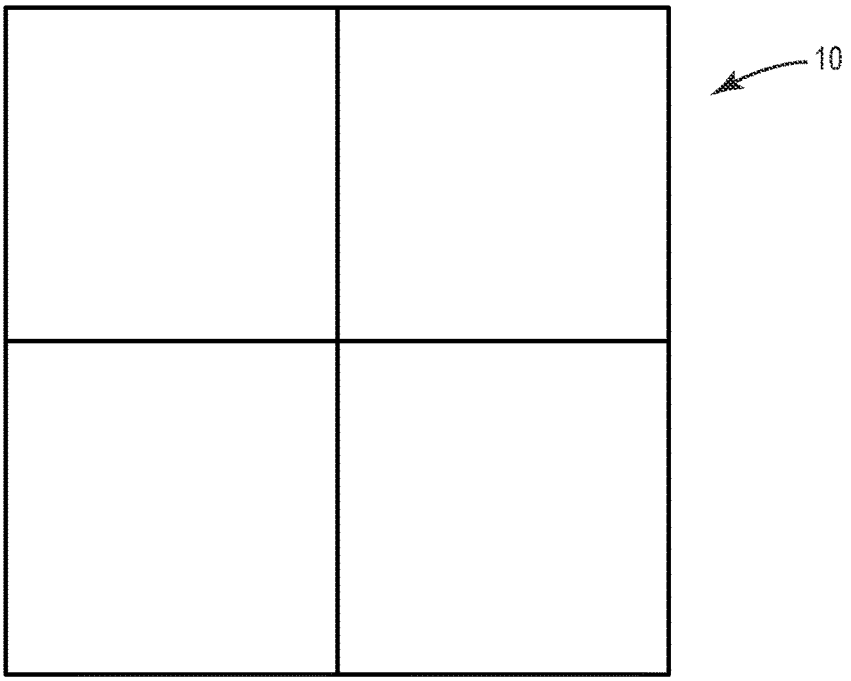
FIGS. 13A and 13B illustrate an alternative embodiment of the expandable table with a square/rectangular configuration.
Figure 13B:
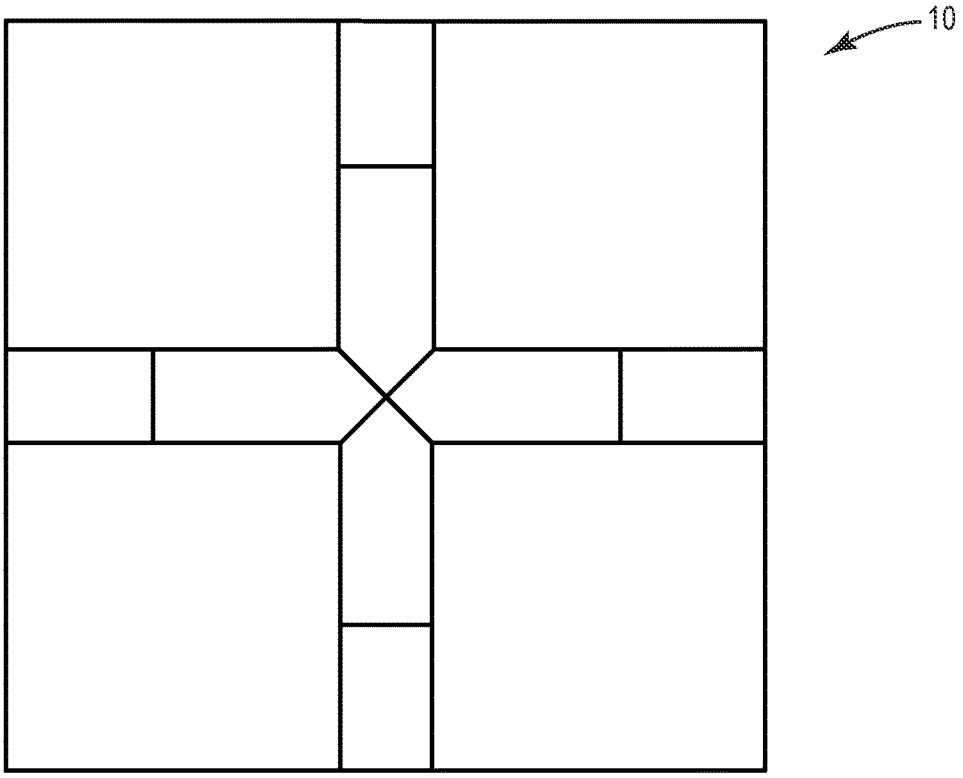

The table geometry could be based on other geometric shapes in addition to a circle. For example, the table could be elliptical, oval, square, rectangular, hexagonal, or octagonal. FIGS. 13A and 13B illustrate a design that is square in the closed or compact configuration and rectangular in an open or expanded configuration. These examples are intended to illustrate some of the possibilities and are not limiting.

The present disclosure may, of course, be carried out in other ways than those specifically set forth herein without departing from essential characteristics of the disclosure. The present embodiments are to be considered in all respects as illustrative and not restrictive, and all changes coming within the meaning and equivalency range of the appended claims are intended to be embraced therein.

What is claimed is:

1. An expandable table comprising:

a frame comprising an apron, a plurality of main rails extending radially between a center of the frame and the apron, and a plurality of expansion rails extending between respective main rails and the apron;

a plurality of main table sections that, in a compact configuration, join at a center to form a small table surface, the main table sections being slidably mounted to respective main rails of the frame so as to diverge when the main table sections slide radially outward from the center;

a plurality of expansion leaves configured for insertion between the main table sections in the expanded configuration, each expansion leaf comprising an outer section and an inner section hingedly connected to the outer section so as to fold in a storage position and to unfold in a deployed position;

a deployment mechanism to facilitate deployment of the expansion leaves from a storage position in the compact configuration to a deployed position in the expanded configuration, the deployment mechanism comprising, for each expansion leaf:

a pivot member connecting the outer section of the expansion leaf to the frame so as to rotate about a pivot axis between the deployed position and the storage position;

a lift guide attached to an expansion rail of the frame and having a guide surface engaged by a follower on the expansion leaf to guide the inner section of the expansion leaf along an inclined path between the storage position and the deployed position when the outer section is rotated about the pivot axis; and wherein the guide surface includes a peak intermediate the ends of the guide surface, a launch portion extending upward from a starting level to the peak of the guide surface, and a landing portion defining an ending level lower than the peak of the guide surface.

2. The expandable table of claim 1, wherein the axis of the pivot member is offset vertically from the plane of the outer section such that the expansion leaf rotates into the plane of the table surface in the deployed position and drops below the plane of the table surface in the storage position.

3. The expandable table of the 2, wherein the outer section and inner section of the expansion leaf assume a folded configuration in the storage position.

4. The expandable table of claim 3, wherein the deployment mechanism further comprises a slotted bracket secured to frame to receive the pivot member so that the expansion leaf moves radially inward and outward.

5. The expandable table of claim 1, wherein, during deployment of the expansion leaf, the follower begins at the starting level, travels upward along the launch portion of the guide surface, over the peak of the guide surface, and comes to rest in the landing portion of the guide surface.

6. The expandable table of claim 1, wherein the side edges of the main table sections include at least one magnet that engages with a magnet in a side edge of an adjacent main table segment in the compact configuration and with a magnet in a side edge of an adjacent expandable leaf in the expanded configuration.

7. The expandable table of claim 1, wherein the side edges of the main table sections include at least one slot configured to receive a post extending from a side edge of an adjacent main segment the compact configuration and with a post extending from a side edge of an adjacent expandable leaf in the expanded configuration.

8. The expandable table of claim 1, wherein the side edges of the expansion leaves include at least one slot configured to receive a post extending from a side edge of an adjacent main segment in the expanded configuration.

9. The expandable table of claim 1, wherein the main table sections comprise slides that are slidably received in open-ended channels in the main rails.

10. The expandable table of claim 9, further comprising removable stoppers insertable into the open ends of the main rails to prevent the main table sections from sliding off of the main rails when the removable stoppers are installed and to allow the main table sections to be removed when the removable stoppers are removed.

11. An expandable table comprising:

a frame comprising a plurality of main rails extending radially between a center of the frame and an outer perimeter of the frame, each main rail including a channel that is open at an outer end of the main rail;

a plurality of main table sections that, in a compact configuration, join at a common center to form a small table surface, the main table sections being slidably mounted in the channels of the main rails so as to diverge when the main table sections slide radially outward from the center and to converge when the main table section slide radially inward;

a plurality of expansion leaves configured for insertion between the main table sections in an expanded configuration, each expansion leaf comprising:

an outer section connected to the frame so as to slide radially inward and outward and to rotate about a sliding pivot axis as the expansion leaf moves between the storage and deployed positions;

an inner section coplanar with the outer section in the deployed position and hingedly connected to the outer section so as to fold back towards the outer section in the storage position, the inner section including a follower that slides along a cam surface on the frame to guide the inner section of the expansion leaf along an inclined path from the storage position to the deployed position when the outer section of the expansion leaf is rotated from the storage position to the deployed position;

removable stoppers insertable into the open ends of the main rails to prevent the main table sections from sliding off of the main rails when the removable stoppers are installed and to allow the main table sections to be removed when the removable stoppers are removed.

12. The expandable table of claim 11, wherein the axis of the pivot member is offset vertically from the plane of the outer section such that the expansion leaf rotates into the plane of the table surface in the deployed position and drops below the plane of the table surface in the storage position.

13. The expandable table of the 13, wherein the outer section and inner section of the expansion leaf assume a folded configuration the storage position.

14. The expandable table of claim 13, wherein the deployment mechanism further comprises a slotted bracket secured to frame to receive the pivot member so that the expansion leaf moves radially inward and outward.

15. The expandable table of claim 11, wherein the guide surface includes a peak intermediate the ends of the guide surface, a launch portion extending upward from a starting level to the peak of the guide surface, and a landing portion defining an ending level lower than the peak of the guide surface.

16. The expandable table of claim 15, wherein, during deployment of the expansion leaf, the follower begins at the starting level, travels upward along a launch portion of the guide surface, over the peak of the guide surface, and comes to rest in the landing portion of the guide surface.

17. The expandable table of claim 11, wherein the side edges of the main table sections include at least one magnet that engages with a magnet in a side edge of an adjacent main table segment in the compact configuration and with a magnet in a side edge of an adjacent expandable leaf in the expanded configuration.

18. The expandable table of claim 11, wherein the side edges of the main table sections include at least one slot configured to receive a post extending from a side edge of an adjacent main segment the compact configuration and with a post extending from a side edge of an adjacent expandable leaf in the expanded configuration.

19. The expandable table of claim 11, wherein the side edges of the expansion leaves include at least one slot configured to receive a post extending from a side edge of an adjacent main segment in the expanded configuration.

20. The expandable table of claim 11, wherein the main table sections comprise slides that are slidably received in open-ended channels in the main rails.

* * * * *